US012781375B2

(12) United States Patent
Wagener et al.

(10) Patent No.: US 12,781,375 B2
(45) Date of Patent: Nov. 3, 2026

(54) METHOD AND SYSTEM FOR FORMING A MULTILAYERED ZINC ALLOY COATING AND METALLIC ARTICLE

(71) Applicant: Parker Hannifin EMEA S.à.r.l., Etoy (CH)

(72) Inventors: Philipp Wagener, Hameln (DE); Manuela Overkemping, Schloss Holte-Stukenbrock (DE); Jan Hustert, Steinhagen (DE); Yindong Ge, Hilliard, OH (US)

(73) Assignee: Parker Hannifin EMEA S.à.r.l., Etoy (CH)

( * ) Notice: Subject to any disclaimer, the term of this patent is extended or adjusted under 35 U.S.C. 154(b) by 727 days.

(21) Appl. No.: 18/153,612

(22) Filed: Jan. 12, 2023

(65) Prior Publication Data

US 2023/0203698 A1 Jun. 29, 2023

Related U.S. Application Data

(63) Continuation of application No. PCT/EP2021/069762, filed on Jul. 15, 2021.

(Continued)

(30) Foreign Application Priority Data

Jul. 31, 2020 (EP) ..... 20188884

(51) Int. Cl.
*C25D 3/56* (2006.01)
*C23F 11/00* (2006.01)

(Continued)

(52) U.S. Cl.
CPC ..... *C25D 3/565* (2013.01); *C23F 11/00* (2013.01); *C25D 5/10* (2013.01); *C25D 5/18* (2013.01);

(Continued)

(58) Field of Classification Search
CPC ..... C25D 3/565; C25D 5/10–14; C25D 5/18
See application file for complete search history.

(56) References Cited

U.S. PATENT DOCUMENTS 3,404,044 A * 10/1968 Russell ..... C23C 22/44 148/268
4,515,663 A * 5/1985 Strom ..... C25D 3/565 205/255

(Continued)

FOREIGN PATENT DOCUMENTS

CN 102203599 A 9/2011
CN 105908228 A 8/2016

(Continued)

OTHER PUBLICATIONS

Thangaraj et al., Surface Modification by Compositionally Modulated Multilayered Zn—Fe Alloy Coatings, 26 Chin. J. of Chem. 2285-91 (Year: 2008).*

(Continued)

*Primary Examiner* — Hosung Chung
(74) *Attorney, Agent, or Firm* — Renner, Otto, Boisselle & Sklar, LLP

(57) ABSTRACT

A method of forming a multilayered zinc alloy coating comprises steps of providing a bath of an aqueous electrolyte including zinc and a second electrodepositable component in an electrolytic cell having an anode and a cathode; applying a current or voltage between the anode and the cathode; modulating the applied current or voltage over time between at least two current or voltage values to thereby modulate the current density over multiple cycles between at least two current density values, wherein a first current density value is in a range of 0.3 to less than 2 A/dm$^2$ and a second current density value is higher than the first current density value and is in a range of 0.6 to less than 5 A/dm$^2$; and controlling the modulation of the applied current or (Continued)

voltage to obtain a multilayered structure having multiple layers of one or more of alternating proportions of the second component, alternating corrosion potential, alternating grain size, and alternating grain orientation, wherein one or more of the multiple layers has a thickness in the range of 1 to 10 μm.

11 Claims, 6 Drawing Sheets

Related U.S. Application Data

(60) Provisional application No. 63/053,038, filed on Jul. 17, 2020.

(51) Int. Cl.

| | |
|---|---|
| ***C25D 5/00*** | (2006.01) |
| ***C25D 5/10*** | (2006.01) |
| ***C25D 5/18*** | (2006.01) |
| ***C25D 17/08*** | (2006.01) |
| ***C25D 21/12*** | (2006.01) |

(52) U.S. Cl.
CPC ..... *C25D 5/625* (2020.08); *C25D 17/08* (2013.01); *C25D 21/12* (2013.01)

(56) References Cited

U.S. PATENT DOCUMENTS

| | | | | |
|---|---|---|---|---|
| 9,611,972 | B2 | 4/2017 | Ishii | |
| 2016/0002790 | A1* | 1/2016 | Whitaker | C25D 5/56 428/626 |
| 2018/0066375 | A1* | 3/2018 | Morgan | C25D 17/16 |
| 2019/0264344 | A1* | 8/2019 | Gaydos | C25D 5/10 |

FOREIGN PATENT DOCUMENTS

| | | | |
|---|---|---|---|
| CN | 109023461 | A | 12/2018 |
| DE | 102008007133 | A1 | 8/2009 |
| JP | H06212443 | A | 8/1994 |
| WO | 2014/007139 | A1 | 1/2014 |

OTHER PUBLICATIONS

International Search Report and Written Opinion of the International Searching Authority for corresponding International Patent Application No. PCT/EP2021/069762, dated Oct. 21, 2021.

Sadananda Rashmi, et al., "Multilayered Zn—Ni alloy coatings for better corrosion protection of mild steel," Engineering Science and Technology, an International Journal, vol. 20, No. 3, Jun. 1, 2017, pp. 1227-1232.

Thangaraj V. et al, "Surface modification by compositionally modulated multilayered Zn—Fe Alloy coatings," Chinese Journal of Chemistry, Zhongguo Kexueyuan, CN, vol. 26, Jan. 1, 2008, pp. 2285-2291.

Bhat Ramesh S. et al., "Compositionally Modulated Multilayered Zn—Co Deposits for Better Corrosion Resistance," Journal of Materials Engineering and Performance, vol. 29, No. 10, Sep. 24, 2020, pp. 6363-6371.

Bahadormanesh et al.: Electrodeposition of nanocrystalline Zn/Ni multilayer coatings from single bath: Influences of deposition current densities and number of layers on characteristics of deposits; Applied Surface Science, vol. 404, Jan. 26, 2017, pp. 101-109.

Li Jiuling: Continuous Hot-dip Galvanizing of Steel Strips (4th Edition); Beijing Metallurgical Industry Press 2019.

Shan Zhongde et al.: Energy-Saving and Emission-Reduction Manufacturing Technology for the Mechanical Equipment Industry, first edition; China Machine Press, Jun. 2014.

* cited by examiner

METHOD AND SYSTEM FOR FORMING A MULTILAYERED ZINC ALLOY COATING AND METALLIC ARTICLE

CROSS-REFERENCE TO RELATED APPLICATIONS

This application is a continuation of international patent application PCT/EP2021/069762, filed on Jul. 15, 2021 designating the U.S., which international patent application has been published in English language and claims priority from U.S. provisional patent application 63/053,038, filed on Jul. 17, 2020, and European patent application 20188884.9, filed on Jul. 31, 2020. The entire contents of these priority applications are incorporated herein by reference.

BACKGROUND

Field of the Disclosure

The present disclosure relates to a method of forming a multilayered zinc alloy coating and to a corresponding system. The present disclosure further relates to a metallic article.

Description of Related Art

As generally known and as e.g. described in Rashmi, S.; Elias, L. & Hegde, A. C. (2017), 'Multilayered Zn—Ni alloy coatings for better corrosion protection of mild steel', *Engineering Science and Technology* (*JESTECH*) 20, 1227-1232, Zinc (Zn) and it's alloy coatings are finding numerous applications in different industries like automotive, electrical, aerospace etc. as sacrificial metallic coatings for the protection of steel components. Electroplated thick Zn coatings were used for many years to give protection for metallic parts economically, whereas nowadays the traditional the Zn coatings are replaced by its alloys due to its ineffectiveness in aggressive or high temperature environments towards corrosion. The alloys of Zn with nobler Fe group metals (Ni, Co, Fe etc.) can give better protection efficacy than pure Zn coatings. Apart from that, the alloys such as Zn—Ni can impart good mechanical properties like hardness, wear resistance etc., as compared with the pure Zn coatings. Hence, it is widely accepted as an eco-friendly alternative to toxic coatings such as cadmium. Amongst all the commonly electroplated alloys, Zn—Ni is the one which is most exploited in commercial applications.

Electroplating of zinc or zinc alloy coatings is mainly carried out with direct current. Pulse plating has some advantages regarding the coating properties (e.g. through laminar structuring) but has not been successfully used in a wider technical application. Alternatives to electrolytically applied corrosion protection are wet and dry paint systems, zinc flake coatings or e-coating. However, the comparatively high costs are again an obstacle to wider industrial use.

US 2019/264344 A1 discloses electrolyte solutions for electrodeposition of zinc-manganese alloys, methods of forming electrolyte solutions, methods of electrodepositing zinc-manganese alloys, and multilayered zinc-manganese alloys. An electrolyte solution for electroplating can include a metal salt, boric acid, an alkali metal chloride, polyethylene glycol, and a hydroxy benzaldehyde. An electrolyte solution can be formed by dissolving a metal salt, boric acid, an alkali metal chloride, polyethylene glycol, and a hydroxy benzaldehyde in water or an aqueous solution. Electrodepositing zinc-manganese alloys on a substrate can include introducing a cathode and an anode into an electrolyte solution comprising a metal salt, boric acid, an alkali metal chloride, polyethylene glycol, and a hydroxy benzaldehyde. Electrodepositing can further include passing a current between the cathode and the anode through the electrolyte solution to deposit zinc and manganese onto the cathode.

The "background" description provided herein is for the purpose of generally presenting the context of the disclosure. Work of the presently named inventor(s), to the extent it is described in this background section, as well as aspects of the description which may not otherwise qualify as prior art at the time of filing, are neither expressly or impliedly admitted as prior art against the present disclosure.

SUMMARY

It is an object to provide a method and system for forming a multilayered zinc alloy coating having an increased corrosion protection. It is a further object to provide a method and system for forming a multilayered zinc alloy coating which offers the advantages of laminar structures in an economical process. It is a further object to provide a corresponding metallic article.

According to an aspect there is provided a method forming a multilayered zinc alloy coating, the method comprising

- providing a bath of an aqueous electrolyte including zinc and a second electrodepositable component in an electrolytic cell having an anode and a cathode;
- applying a current or voltage between the anode and the cathode;
- modulating the applied current or voltage over time between at least two current or voltage values to thereby modulate the current density over multiple cycles between at least two current density values, wherein a first current density value is in a range of 0.3 to less than 2 $A/dm^2$ and a second current density value is higher than the first current density value and is in a range of 0.6 to less than 5 $A/dm^2$; and
- controlling the modulation of the applied current or voltage to obtain a multilayered structure having multiple layers of one or more of alternating proportions of the second component, alternating corrosion potential, alternating grain size, and alternating grain orientation, wherein one or more of the multiple layers has a thickness in the range of 1 to 10 μm.

According to a further aspect there is provided a system for forming a multilayered zinc alloy coating

- a bath of an aqueous electrolyte including zinc and a second electrodepositable component in an electrolytic cell having an anode and a cathode;
- a current or voltage source configured to apply a current or voltage between the anode and the cathode;
- a controller configured to modulate the applied current or voltage over time between at least two current or voltage values to thereby modulate the current density over multiple cycles between at least two current density values, wherein a first current density value is in a range of 0.3 to less than 2 $A/dm^2$ and a second current density value is higher than the first current density value and is in a range of 0.6 to less than 5 $A/dm^2$, and to control the modulation of the applied current or voltage to obtain a multilayered structure having multiple layers of one or more of alternating proportions of the second component, alternating corrosion potential, alternating grain size, and alternating grain orientation, wherein one or more of the multiple layers has a thickness in the range of 1 to 10 μm.

According to a further aspect there is provided a metallic article comprising a metallic substrate and a multilayered zinc alloy coating formed on the metallic substrate, the multilayered zinc alloy coating including a multilayered structure having multiple layers of one or more of alternating proportions of the second component, alternating corrosion potential, alternating grain size, and alternating grain orientation, wherein one or more of the multiple layers has a thickness in the range of 1 to 10 μm.

Embodiments are defined in the dependent claims. It shall be understood that the disclosed system has similar and/or identical further embodiments as the claimed method and as defined in the dependent claims and/or disclosed herein.

Laminar zinc alloy coatings are an efficient corrosion protection, but also complex and expensive to use. While according to the current state of the art, such structures are produced by complex and thus expensive pulse-plating rectifiers, which are not available in most electroplating lines, according to the present disclosure standard equipment (DC rectifiers, etc.) as found in many electroplating lines can be used.

Another fundamental disadvantage of known methods is that the deposition process is not continuous, which results in lower efficiency and therefore slower plating due to down times between pulses ("duty cycle"). In contrast, according to the present disclosure a modulated direct current deposition of zinc alloy layers in an economically advantageous process is applied.

Thus, according to the present disclosure a robust method is presented which allows electroplating of laminar structures with standard plating line equipment and which can be used in an industrial manufacturing process. A lamellar microstructure can be produced with standard equipment resulting in a high application potential. In addition, the effect of better corrosion performance even after deforming through (micro-) laminar structure is achieved.

It should be noted that in the context of the present disclosure the terms "first" and "second" shall not be understood as indication of a consecutive order, but are meant solely to differentiate the at least two current density values. The modulation of the current density values does hence not necessarily start with the first (lower) current density value followed by the second current density value, but may start with the second current density value followed by the first current density value. In other embodiments the modulation may start neither with the first nor the second current density value but a further (different) current density value (or even more different current density values). In still other embodiments one or more further current density values may be used in between the first and second current density values. Further, the expression "less than" shall generally be understood as meaning "up to but excluding". For instance, "a range from a to less than b" shall be understood as "a range from a to b, but excluding b".

According to an embodiment the modulation of the applied current or voltage is controlled to form the multilayered structure having 2 to 20 layers, in particular 4 to 12 layers. A number of layers in this range provides a good corrosion performance and avoids a total thickness in the desired range.

According to another embodiment the modulation of the applied current or voltage is controlled to form the multilayered structure having multiple layers, each having a thickness in the range of 1 to 10 μm, in particular in the range of 1 to 5 μm. This allows the use of low-cost DC rectifiers instead of more complex AC rectifiers which are necessary for nanometer-scale layers.

Preferably, the second electrodepositable component is one of nickel, iron, cobalt, copper, gold, silver, platinum, chromium, lead, tin or a combination thereof. In practical implementations, nickel is advantageously used, which provides a good corrosion protection efficacy as well as a good mechanical properties like hardness, wear resistance, etc. Manganese is not a preferred material for the second electrodepositable component, in particular due to its visual appearance and potential problems in handling and treatment, and in so far the bath used may be considered substantially manganese-free.

According to another embodiment the modulation of the applied current or voltage is controlled to form the multilayered structure having a total thickness in the range of 5 to 25 μm, in particular in the range of 8 to 16 μm. In this range the desired properties of the multilayered structure, like corrosion performance and micro crack density, can be obtained.

The modulation of the applied current or voltage may further be controlled to alternate the current density over multiple cycles between at least two different current density values, wherein each of the current density values is applied in a cycle for a duration in the range of 30 seconds to 60 minutes, in particular in a range of 1 to 15 minutes. Hereby, the durations and the current density values may be controlled individually per layer or per each second layer.

Generally, ductility of the electroplated layer is a function of current density. By variation of more and less ductile layers a network of micro cracks is generated when the coating is bended or just releases mechanical stress after plating. A network of small and multiple cracks results in fine dispersion of the corrosion current which leads to a slower corrosion. In addition, alloy incorporation and/or electrochemical potential and/or grain size and/or grain orientation is controlled by current density. As a result of one of or a combination of these properties, corrosion potential of the alternating layer is varied. A coating of layers with alternating nobility results in anisotropic corrosion properties. Consequently, a corrosion attack preferably propagates in parallel to the layers and penetration in the direction of the base material is slowed down. The control of the currently density is thus driven by the desired properties. The duration is mainly controlled to obtain a desired thickness of a layer.

Preferably, the method further comprises a step of forming a passivation layer on top of the multilayered structure, in particular by mutual corrosion protection reinforcement of plating and passivation layer properties, and a step of forming a sealing layer on top of the passivation layer. Forming a passivation layer and a sealing layer further improves the corrosion performance. Since passivation layer thickness is generally quite thin (e.g. less than 1 μm), it does not level or mitigate plating roughness and does not impact friction properties significantly. Consequently, a final layer of a sealer or topcoat (also called sealing layer herein) may be added on top of the passivation layer to adjust friction properties and further increase corrosion performance.

In another embodiment the current or voltage applied for forming the final layer of the multilayered structure is controlled to form the final layer having a lower proportion of the second component than the penultimate layer. This ensures in increased ability of the final layer to interact with the subsequently formed passivation layer.

One or more chemical or physical parameters, in particular one or more of alloying metal content, crystal structure and micro cracks, are controlled for forming the final layer of the multilayered structure.

In an embodiment one or more parameters for forming the final layer of the multilayered structure and for forming the passivation layer are controlled so that in the forming of the passivation layer the top part of the final layer of the multilayered structure is converted to form at least part of the passivation layer, i.e., so that the passivation layer and the top part of the final layer of the multilayered structure interact well with each other leading to the desired increased corrosion performance. In this process step corrosion, friction, plating layer adhesion and ion release properties are thus tunable/controllable independently from each other. Depending on which of the one or more properties are of most interest, corresponding one or more parameters are controlled, wherein in practice a compromise is made between the different properties. In literature (e.g. Kanagasabapathy, M. & Jayakrishnan, S.: Textural and morphological studies on zinc-iron alloy electrodeposits *J. Chem. Sci.*, 2011, 123, 357-364), there is evidence that current density is an important process control to adjust layer properties. Kanagasabapathy et al. demonstrated the current density-based control of alloy incorporation, crystal structure and subsequent corrosion properties. In addition they showed control of morphology which has a strong impact on tribology and friction properties.

The passivation layer is preferably formed from one or more of chromium oxide, zirconium oxide, zinc oxide, titanium oxides, vanadium oxides, organofunctional silanes, and organic polymers. In practical solutions chromium oxide may advantageously be used.

In a preferred embodiment the initial current density is controlled such that nucleation and growth of the first layer is optimal for adhesion and throwing power, the current density for growth of intermediate layers is controlled to optimize corrosion performance and micro crack density, and the final current density for forming of the final layer is controlled to optimize ability for passivation and surface roughness.

The multilayered zinc alloy coating may be formed by use of a rack, in which case the first (lower) current density value is in a range of 0.5 to less than 2 $A/dm^2$ and the second (higher) current density value is in a range of 2 to less than 5 $A/dm^2$. The second current density value is higher than the first current density value by a value difference in the range of 0.5 to 4 $A/dm^2$. In further embodiments the first current density may be in a range of 0.5 to 1.5 or 0.5 to 1 $A/dm^2$ and the second current density may be in a range of 2 to 4.8 or 2 to 4 $A/dm^2$.

Alternatively, the multilayered zinc alloy coating may be formed by use of a barrel, in which case the first (lower) current density value is in a range of 0.3 to 1 $A/dm^2$ and the second (higher) current density value is in a range of 0.6 to 2 $A/dm^2$. In this case the second current density value is higher than the first current density value by a value difference in the range of 0.2 to 1 $A/dm^2$. In further embodiments the first current density may be in a range of 0.3 to 0.8 or 0.5 to 1 $A/dm^2$ and the second current density may be in a range of 0.6 to 1.5 or 1.2 to 2 $A/dm^2$.

The present disclosure further relates to a metallic article having a metallic substrate and a multilayered zinc alloy coating formed on the metallic substrate, the multilayered structure having multiple layers of alternating proportions of a second component and/or electrochemical potential and/or of alternating grain size and/or of alternating grain orientation. The thickness of the individual layers is in the range of 1 to 10 μm. The multilayered zinc alloy coating is formed by a method as disclosed herein. The metallic article may further comprise a passivation layer formed on top of the multilayered structure, wherein the top part of the final layer of the multilayered structure is converted and forms at least part of the passivation layer.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWING

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Plating parameters and subsequent coating properties are usually a compromise between a manifold of requirements like corrosion protection, coating adhesion or tribology.

Most of the influencing variables cannot be changed during the process and need to be defined before the plating process when using a single plating tank (single bath electrodeposition). This limitation to a fixed set of plating parameters could be avoided by use of multiple plating tanks (multiple bath electrodeposition). In this approach, the substrate or part is plated in one tank after each other to give multiple layers with different properties. However, this method is not easy to implement in industrial use since process time and complexity is much higher.

In the more common single bath approach, the only parameter (besides time) that can generally be altered in a practicable way during a plating process is current density. However, a variation in current density has an impact on several physical and chemical properties:

- Affecting corrosion protection: Alloying metal content, crystal structure, micro cracks
- Affecting coating adhesion and throwing power: Nucleation, grain size
- Affecting tribology: grain size, roughness Thus, current density is generally chosen as a comprise between all requirements of the electro-deposited coating and subsequent post-treatments, such as forming a passivation layer and a sealer.

Figure 1:
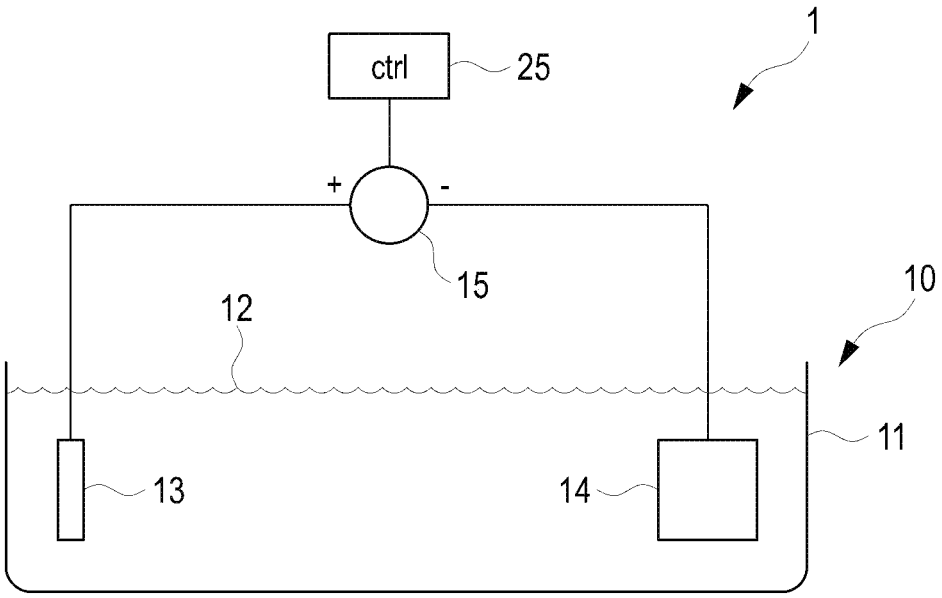
FIG. 1 shows a schematic diagram of a system for forming a multilayered zinc alloy coating according to the present disclosure.

FIG. 1 shows a schematic diagram of a system 1 for forming a multilayered zinc alloy coating according to the present disclosure. The system 1 comprises an electrolytic plating cell or bath 10 having an enclosure 11 that contains a liquid electrolytic solution 12. Inside the solution 12 an anode 13 and a cathode 14 are arranged. A supply unit 15, e.g. a current or voltage source, applies a current or voltage between the anode 13 and the cathode 14. A controller 16 controls the forming of the multilayered zinc alloy coating by controlling the applied current or voltage over time.

The electrolytic solution 12 contains ions of the metals which are to be plated onto the cathode 13, in particular zinc and at least a second metal (e.g. nickel). The plating current (or voltage), and thus the current density between the anode 13 and the cathode 14, is controlled by the controller 16 to plate and form the multilayered zinc alloy coating on the cathode 14. The controller 16 particularly modulates the applied current or voltage over time between at least two current or voltage values to thereby modulate the current density over multiple cycles between at least two current density values, particularly a lower (also called "first") and a higher (also called "second") current density value which may be applied in any sequence, i.e., the lower current density value being applied first and the higher current density value being applied second, or in the opposite order of the higher current density value being applied first and the lower current density value being applied second. In this way, metal ions from the electrolytic solution 12 are deposited upon the cathode 14 in alternating layers thereof to define the multilayered zinc alloy coating, wherein the composition and properties of the individual layers is controlled through the control of the current density.

The system 1 is able to at least partly use standard plating line equipment, e.g. a DC rectifier as part of the supply unit 15 that rectifies an external AC current provided by a public power supply. The system 1 thus provides an economically advantageous process that can be use in an industrial manufacturing process with limited investment and changes of standard plating line equipment and thus has a high application potential.

Figure 2:
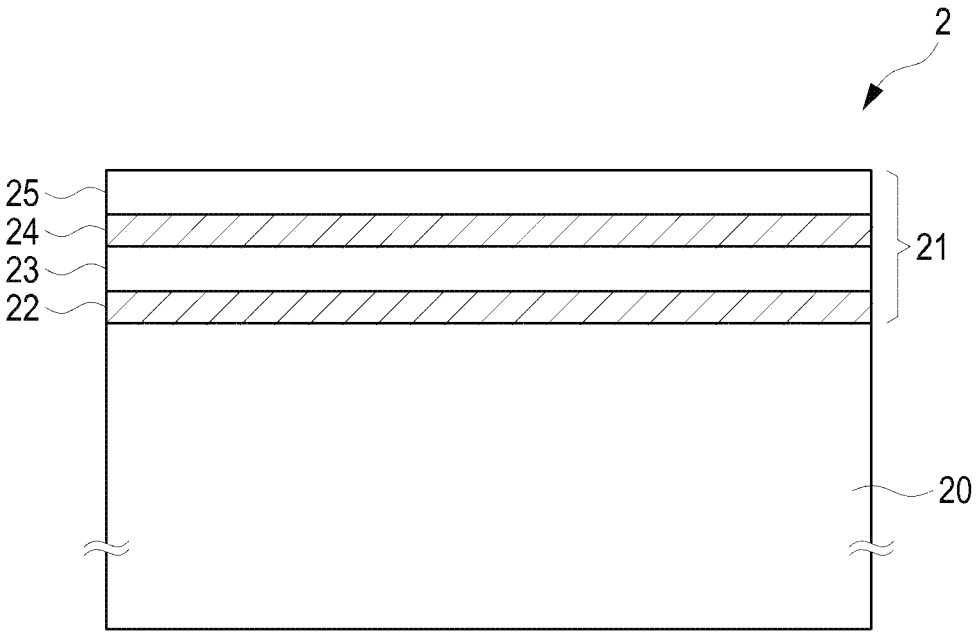
FIG. 2 shows a schematic diagram of an embodiment of a metallic article having a multilayered zinc alloy coating according to the present disclosure.

FIG. 2 shows a schematic diagram of an embodiment of a metallic article 2 having a multilayered zinc alloy coating according to the present disclosure. The metallic article 2 may e.g. be a hydraulic component made of steel, but may generally any component on which an efficient corrosion protection shall be provided.

The metallic article 2 comprises a metallic substrate 20 (used as cathode 14 in the system 1) and the multilayered zinc alloy coating formed on the metallic substrate 20. The multilayered zinc alloy coating is, in this embodiment, formed by a multilayered structure 21, which represents the coating and has multiple (in this exemplary embodiment four) layers 22-25 of alternating proportions of a second component in addition to zinc. The multilayered structure 21 may be formed by use of the system 1 and a method of controlling the current density in a way as described in more detail below.

Generally, the multilayered structure 21 may have 2 to 20 layers. Preferably, the number of layers is in the range of 4 to 12. The thickness of each of the layers 22-25 of the multilayered structure 21 is generally in the range of 1 to 10 μm, preferably in the range of 1 to 5 μm. The total thickness of the multilayered structure 21 is generally in the range of 5 to 25 μm, preferably in the range of 8 to 16 μm.

The second electrodepositable component of the layers, in addition to zinc as first component, is one of nickel, iron, cobalt, copper, gold, silver, platinum, chromium, lead, tin or a combination thereof.

In this embodiment, the thickness of each of the layers 22-25 is substantially equal, but the proportion of the second component (e.g. nickel) is different. In this embodiment the first and third layers 22 and 24 have substantially the same first proportion of the second component, and the second and fourth layer 23 and 25 have substantially the same second proportion of the second component, wherein the first proportion is lower than the second proportion.

Figure 3A:
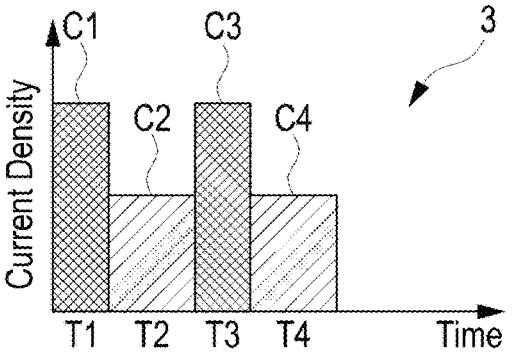
FIG. 3A shows a diagram of the current density over time according to an embodiment of the present disclosure used for controlling the current density to obtain the metal article shown in FIG. 2.
Figure 3B:
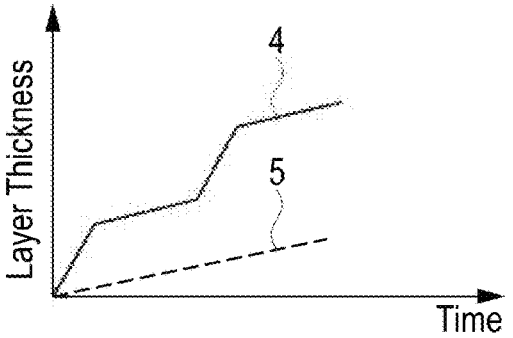
FIG. 3B shows a diagram of the total thickness of the multilayered structure as it grows over time when the current density is controlled as shown in FIG. 3A.

FIG. 3A shows a diagram of the current density 3 over time and FIG. 3B shows a diagram of the total thickness 4 of the multilayered structure 21 as it grows over time when the current density is controlled as shown in FIG. 3A. FIG. 3B further indicates, for comparison, the total thickness 5 of a single layer structure as it grows over time when a constant current density is applied.

As shown in FIGS. 3A and 3B in first and third time intervals T1 and T3 (in which the first and third layers 22 and 24 are formed) a higher current density C1 and C3 is applied leading to faster growth of the total layer thickness 4 than the current density C2 and C4 applied in the second and fourth time intervals T2 and T4 (in which the second and fourth layers 23 and 25 are formed). Further, via the current density value the proportion of the second component in the respective layer can be controlled, i.e., the higher current density leads to a lower proportion than a higher current density.

The length of the time intervals T1-T4 may be identical, but they may also be controlled individually to individually control the thickness of each layer. In a preferred embodiment, as shown in FIG. 3A, the length of the time intervals T1 and T3 is equal and the length of the time intervals T2 and T4 is equal, wherein the length of the time intervals T1 and T3 is shorter than the length of the time intervals T2 and T4. In this way, it can be ensured that the thickness of all layers 22-25 is in the same range. In other words, a higher current density leads to faster plating and thus requires a lower plating time. The length of all time intervals is generally in the range of 30 seconds to 60 minutes, preferably in the range of 1 to 15 minutes.

The first and third current density values C1 and C3 are preferably equal and the second and fourth current density values C2 and C4 are preferably equal, wherein C1 and C3 are higher than C2 and C4. In another embodiment the current density values C1-C4 may be controlled individually to individually control the growth rate of each layer and proportion of the second component in each layer.

The multilayered structure may be formed by use of a rack using rack plating, in which method the parts on which the multilayered structure shall be formed are mounted to a rack, which is then placed into the bath of electrolytic solution. In this case the first and third current density values C1 and C3 are preferably in a range of 0.5 to less than 2 A/dm$^2$, in examples up to 3 A/dm$^2$, and the second and fourth current density values C2 and C4 are preferably in a range above 3 A/dm$^2$ (preferably in a range of 3 to less than 5 A/dm$^2$, in examples up to 6 A/dm$^2$). Rack plating generally has the advantages of being usable with larger/heavier parts and showing less carryover of the electrolytic solution. Values in the range of 1 to less than 2 A/dm$^2$ for C1 and C3 and values in the range of 3 to 4 A/dm$^2$ for C2 and C4 have shown good results under different conditions of the rack plating process. Generally, C2 and C4 have higher values than C1 and C3, preferably by a value difference in the range of 0.5 to 4 A/dm$^2$.

In another embodiment the multilayered structure may be formed by use of a barrel using barrel plating, in which method the parts on which the multilayered structure shall be formed are placed into a barrel containing the bath of electrolytic solution. In this case the first and third current density values C1 and C3 are preferably in a range of 0.3 to 1 A/dm$^2$ and the second and fourth current density values C2 and C4 are preferably in a range of 0.6 to 2 A/dm$^2$, preferably above 1 A/dm$^2$ or even above 1.2 A/dm$^2$. Since too high current densities have unwanted side effects (like burnings, amorphous plating, decreasing plating efficiency, forming of hydrogen) they should be avoided. In practical embodiments, the second and fourth current density values C2 and C4 are not higher than 2 A/dm$^2$, in examples not higher than 4 to 5 A/dm$^2$. Barrel plating generally has the advantages of being usable with many smaller/lighter parts, requiring less efforts and having a more homogeneous current density. Values in the range of 0.4 to 0.7 A/dm$^2$ for C1 and C3 and values in the range of 0.6 to 1.2 A/dm$^2$ for C2 and C4 have shown good results under different conditions of the barrel plating process. Generally, C2 and C4 have higher values than C1 and C3, preferably by a value difference in the range of 0.2 to 1 A/dm$^2$.

In an exemplary embodiment, e.g. using nickel as second component, the proportion of nickel in the first and third layers 22 and 24 may be in the range from 12 to 16, e.g. 13%, and the proportion of nickel in the second and fourth layers 23 and 25 may be in the range from 8 to 12, e.g. 11%. The thickness of the first and third layers 22 and 24 may be 3.9 μm and the thickness of the second and fourth layers 23 and 25 may be 4.3 μm. The multilayered structure 21 preferably has corrosion current $I_{corr}$ of approximately 5 μA/dm$^2$ and a coating impedance $Z_{Nyquist}$ of approximately 1Ω.

Figure 4:
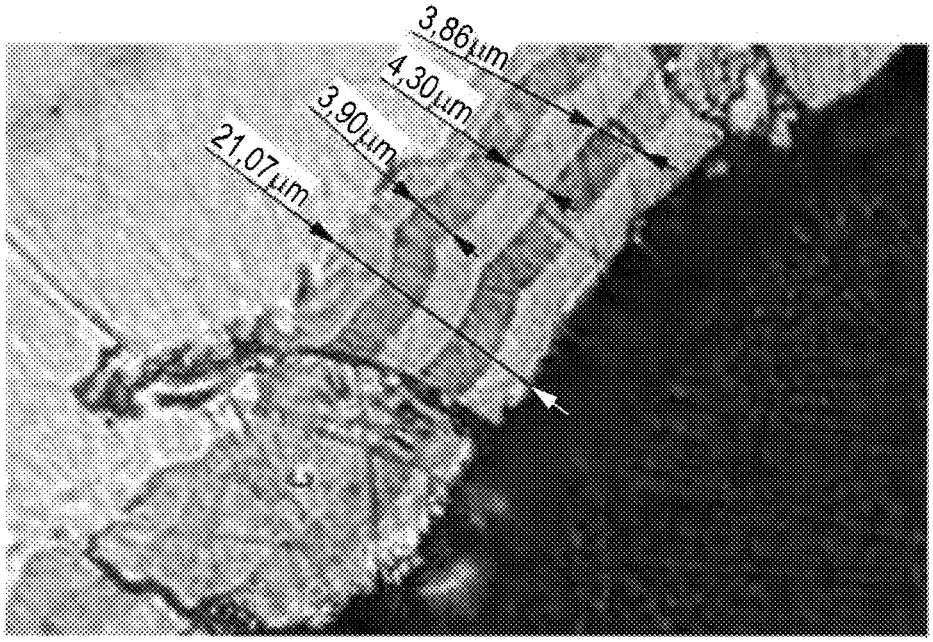
FIG. 4 shows a cross sectional view of a part of a metallic article according to the present disclosure.

FIG. 4 shows a cross sectional view of a part of a metallic article (after staining procedure) having a coating with four layers as shown in FIG. 2 obtained by controlling the current density as shown in FIG. 3A. For optimal visualization of the individual layers a mild oxidizing agent was used for the staining procedure.

Figure 5:
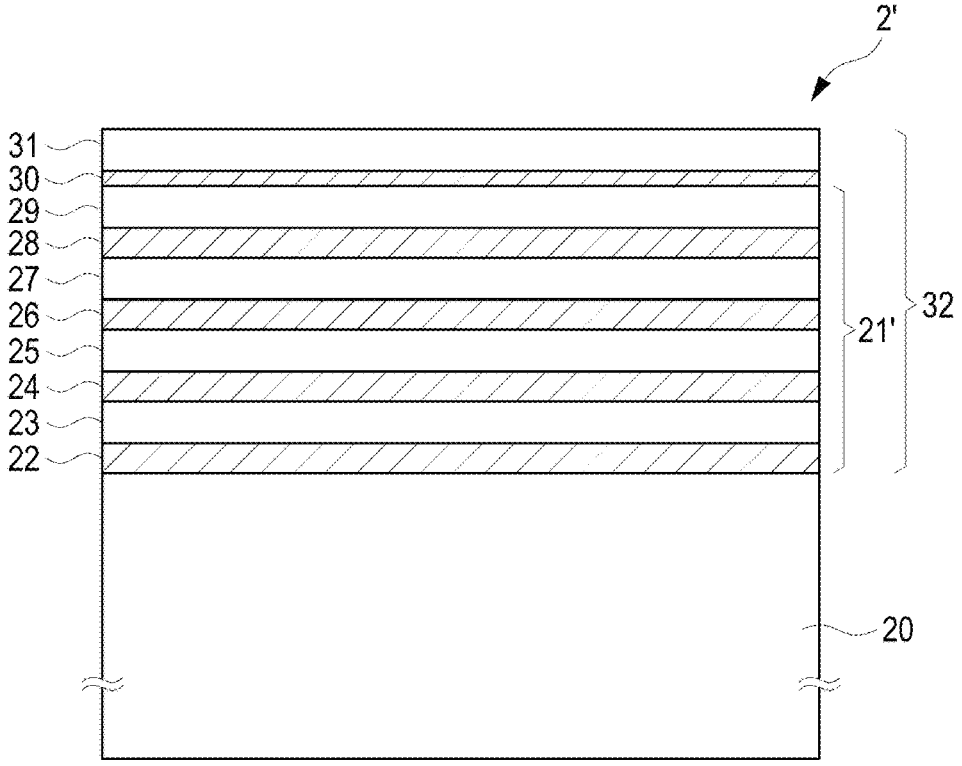
FIG. 5 shows a schematic diagram of another embodiment of a metallic article having a multilayered zinc alloy coating according to the present disclosure.

FIG. 5 shows a schematic diagram of another embodiment of a metallic article 2' according to the present disclosure. In this embodiment the multilayered structure 21' comprises eight layers 22 to 29. Further, in addition to the multilayered structure 21' the coating 32 of the metallic article 2' further comprises a passivation layer 30 on top of the multilayered structure 21' and a sealing layer (also called topcoat layer) 31 on top of the passivation layer 30. The passivation layer 30 is provided to increase the final corrosion performance and the ability of adhesion of the sealing layer 31. The sealing layer 31 is provided to further increase the final corrosion performance.

The passivation layer 30 is formed from one or more of chromium oxide, zirconium oxide, zinc oxide, titanium oxides, vanadium oxides, organofunctional silanes, and organic polymers. The thickness of the passivation layer 30 is preferably in the range of 0.1-0.5 μm, e.g. approximately 0.5 μm. The passivation layer 30 preferably has corrosion current $I_{corr}$<0.2 μA/dm$^2$ and a coating impedance $Z_{Nyquist}$>50 kΩ.

The sealing layer 31 is formed from an aqueous polymer solution. The thickness of the sealing layer 31 is preferably in the range of 0.5-3 μm, e.g. approximately 2 μm. The sealing layer 31 preferably has corrosion current $I_{corr}$<0.3-0.6 μA/dm$^2$ and a coating impedance $Z_{Nyquist}$>5-8 kΩ.

Figure 6A:
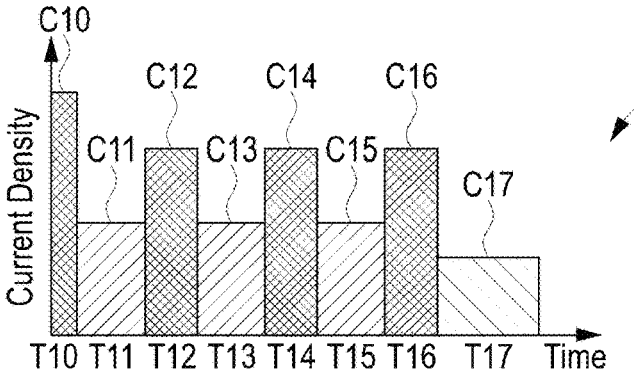
FIG. 6A shows a diagram of the current density over time according to another embodiment of the present disclosure used for controlling the current density to obtain the metallic article shown in FIG. 5.
Figure 6B:
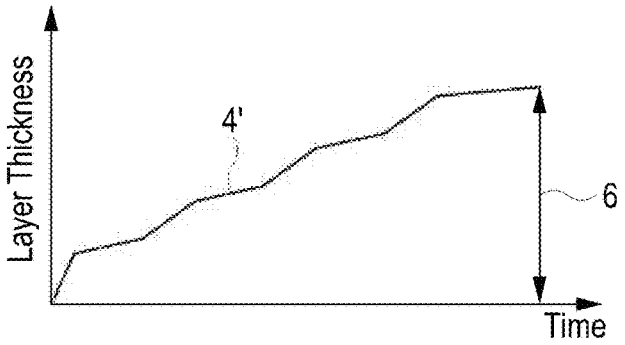
FIG. 6B shows a diagram of the total thickness of the coating as it grows over time when the current density is controlled as shown in FIG. 6A.

FIG. 6A shows a diagram of the current density 3' over time used for controlling the current density to obtain the metallic article 2' shown in FIG. 5. FIG. 6B shows a diagram of the total thickness 4' of the coating 32 as it grows over time when the current density is controlled as shown in FIG. 6A.

Similar to the embodiment shown in FIG. 3A, in the time intervals T10, T12, T14 and T16 (in which the layers 22, 24, 26 and 28 are formed) a higher current density C10, C12, C14 and C16 is applied leading to faster growth of the total layer thickness 4' than the current density C11, C13, C15 and C17 applied in the other time intervals T11, T13, T15 and T17 (in which the other layers 23, 25, 27 and 29 of the multilayered structure 21' are formed). Generally, the plating thickness 6 of the multilayered structure 21' is in the range of 5-25 μm and the number of layers is in the range of 2-20, each layer having a thickness in the range of 1-10 μm.

Like in the embodiment shown in FIG. 3A, the length of the time intervals T10-T17 may be identical, but in the embodiment shown in FIG. 6A the length of the first and last time intervals T10 and T17 is different than the length of the other time intervals T11-T16 (of which T11, T13 and T15 are identical and T12, T14 and T16 are identical). Likewise, the current density values C10 and C17 are different from the other current density values C11-C16 (of which C11, C13 and C15 are identical and C12, C14 and C16 are identical). Generally, the current density values C11-C16 are in the ranges mentioned above in the context of the embodiment shown in FIG. 3A, depending on whether rack plating or barrel plating is used.

In this embodiment, as shown in FIG. 6A, the current density value C10 for forming the first layer 22 generally depends on the geometry of the plated parts and is higher than the other current density values, but is applied for a shorter time T10. This controls the forming of the first layer 22 such that it provides a good adhesion to the base layer (the metallic substrate 20).

The current density value C17 for forming the final layer 29 of the multilayered structure 21' generally depends on the passivation chemistry and may be lower or higher than the other current density values, but is applied for a longer time T17. This controls the forming of the final layer 29 such that it has a lower proportion of the second component or a different crystal structure than the penultimate layer 28. This provides a low roughness of the final layer 29 and further has the advantage that the final layer 29 has a better ability to interact with the passivation layer 30. In particular, when forming the passivation layer 30, e.g. by placing the metallic substrate 20 carrying the multilayered structure 21' into a solution e.g. including chromium, the passivation solution dissolves the outer surface, e.g. up to a micrometer, of the final layer and forms a new passivation layer (conversion layer). The chromium interacts with the zinc alloy of the final layer 29 and converts its uppermost surface area, at least partly, into the final passivation layer 30 of e.g. chromium dioxide.

Figure 7:
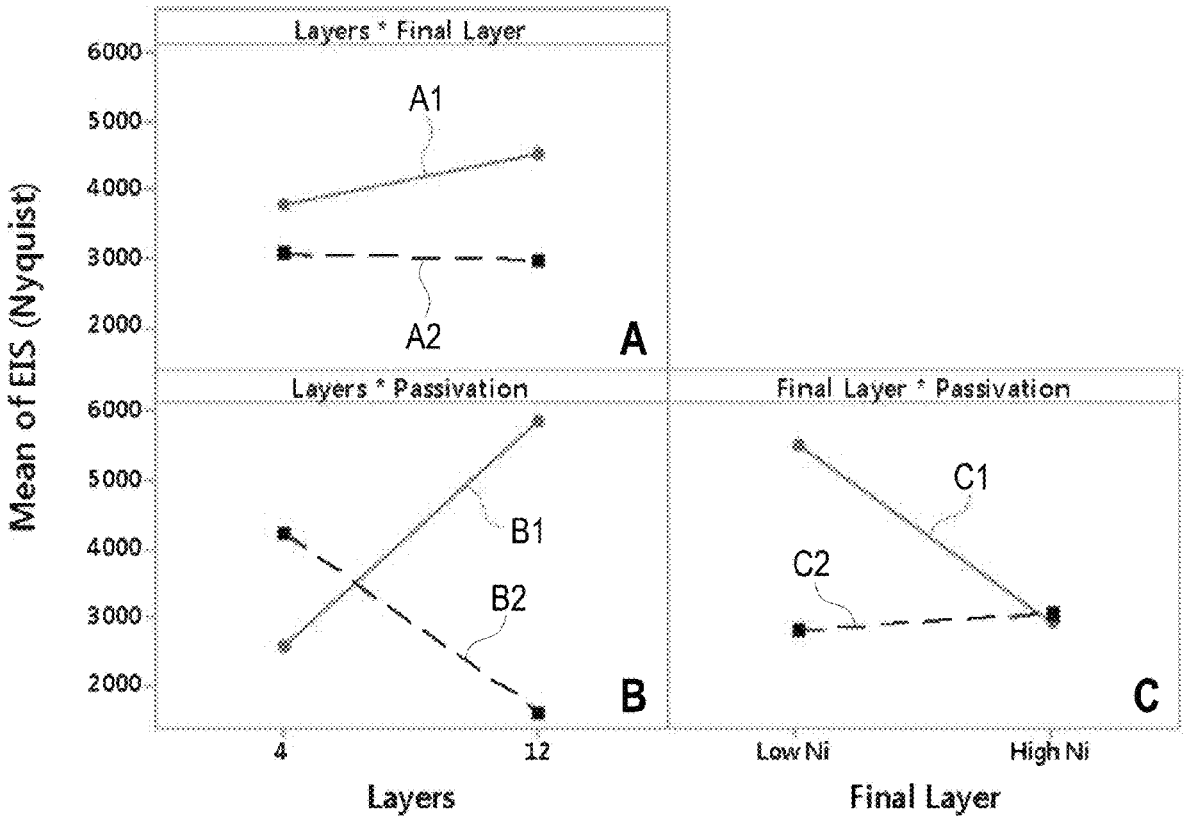
FIG. 7 shows a diagram illustrating the interaction between the passivation layer and the final layer of the multilayered structure.

FIG. 7 shows a diagram illustrating the interaction between the passivation layer 30 and the final layer 29 of the multilayered structure 21'. FIG. 7 particularly shows plots of the mean of electrochemical impedance spectroscopy (EIS) over the number of layers of the multilayered structure 21' (plots A and B) and over the proportion of nickel (Ni) in the final layer 29 (plot C). EIS is a parameter that implicitly indicates the corrosion performance.

Plot A shows the EIS for a final layer 29 having a low proportion of Ni (plot A1) and for a final layer 25 having a high proportion of Ni (plot A2), both for a multilayered structure 21' between 4 and 12 layers in total. It can be recognized that the number of layers does not have a large influence on the EIS, which is valid for both types of final layers.

Plot B shows the EIS for a passivation layer 30 of 128CF (a cobalt-free trivalent chromium passivate for zinc and zinc-nickel deposits (12-15% Ni) of Coventya) (plot B1) and a passivation layer of IZ 264 CF (a conventional passivation chemistry of Dipsol Chemicals) (plot B2), both for a multilayered structure 21' between 4 and 12 layers in total. It can be recognized that the type of passivation totally changes the behavior of EIS depending on the number of layers. This plot shows, for instance, that the mutual corrosion protection reinforcement of plating and passivation layer properties is best with 12 layers for 128CF and with 4 layers for IZ 264 CF. It shall be noted that other materials of other manufacturers may be applied as well.

Plot C shows the EIS for a passivation layer 30 of 128CF (plot C1) and a passivation layer of 264 (plot C2), both for a final layer 29 between a low and high proportion of Ni. It can be recognized that the type of passivation again has a strong impact on the behavior of EIS depending on the proportion of Ni in the final layer. Further, the affinity of passivation may be controlled by the final layer properties.

According to known methods, the current density is chosen as a compromise between all requirements of the electro-deposed coating and subsequent post-treatments such as passivation and sealer. By the method according to the present disclosure, however, it is possible to tailor the coating properties to all the different needs. In particular, the first layer 22 of the multilayered structure 21' may be optimized for adhesion by use of a current density that optimizes nucleation and grain size. The subsequently formed intermediate layers 23-28 may be optimized for corrosion performance, nickel release and micro cracks. The final layer 29 may be optimized for ability to passivation and tribology (roughness).

In a practical embodiment a corrosion-protective coating of a steel-made hydraulic connector may be manufactured using rack plating in an acidic process as follows. A commercial zinc nickel plating bath is prepared according to the chemical supplier's specification and filled in an electro plating tank with solvable Nickel and Zinc anodes. Hydraulic connector steel parts are placed on a plating rack and cleaned by soak, electro cleaner and pickling (rinsing between each process step). The plating rack including the parts is put into the plating bath which is agitated by air injection and movement of the plating rack using a cathode rocker. First, a low current density (e.g. 0.5 A/dm$^2$) is applied for 12 minutes followed by an alternating current density of 1 A/dm$^2$ and 3 (or up to, but preferably less than 5) A/dm$^2$ for 6 minutes and 1.5 minutes, respectively, until a total number of 6 layers is plated. The final zinc nickel layer is plated by a current density of 0.8 A/dm$^2$ for 9 minutes. After-treatment of the parts is done by acid pre-dip using diluted hydrochloric acid and followed by chromium (III)-based passivation. After rinsing a final layer of a mineral-organic sealer is applied by dip-coating and drying with hot air (e.g. at 80° C.).

The embodiments described above control the current density to provide a metallic article having an alternating proportion of a second component (e.g. Ni) in addition to Zn. In other embodiments, the control of the current density may be used to provide a metallic article having an alternating corrosion potential and/or an alternating grain size and/or an alternating grain orientation, in addition to or instead of the alternating proportion of the second component, in the layers of the multilayered structure. For instance, in a barrel plating approach using the same electrolyte as mentioned above a lower current density difference between high (1.2 A/dm$^2$) and low (0.8 A/dm$^2$) current density may be used in an acidic process. In this case, the difference in Nickel incorporation between the layers is not significant. However, the corrosion potential or nobility of the layers differ. This can be easily visualized by cross-sectioning and staining using mild oxidizing agents (e.g. diluted nitric acid in ethanol solution (1-2%)). The intensity of colorization depends on corrosion potential and results in distinguishable layers of different color.

In another embodiment of an acidic process using barrel plating, e.g. by use of a single anode, the current density may be alternated between approximately 0.4 A/dm$^2$ and 0.6 A/dm$^2$. In another embodiment of an alkaline process using rack plating, e.g. by use of an insoluble steel anode, the current density may be alternated between approximately (preferably slightly less than) 2 A/dm$^2$ and 4 A/dm$^2$. In still another embodiment of an alkaline process using barrel plating, e.g. by use of an insoluble steel anode, the current density may be alternated between approximately 0.4 A/dm$^2$ and 1.1 A/dm$^2$.

Generally, different aqueous electrolytes may be used in the bath to influence the sensitivity to the incorporation of the second component into the layers. The different aqueous electrolytes further influences the formation of the grain size and/or grain orientation.

Figure 8A:
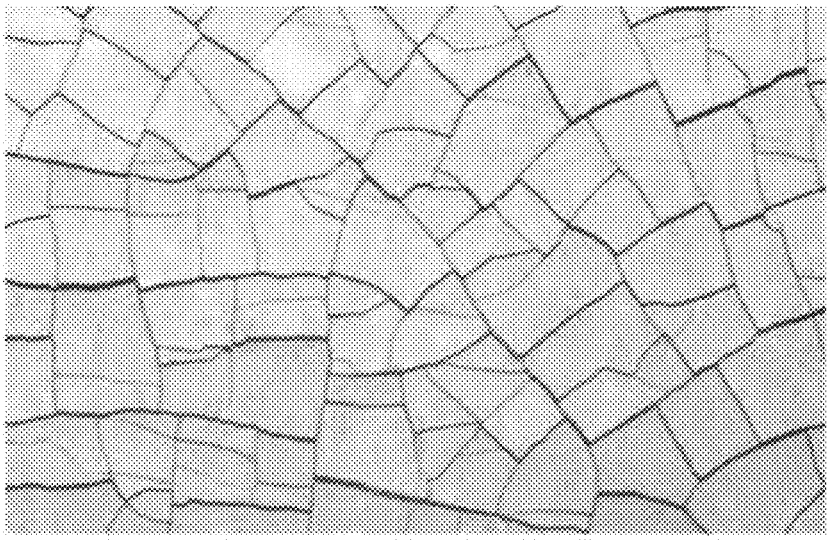
FIG. 8A shows a top view of a micro crack network of a deformed surface of a structured coating according to the present disclosure.
Figure 8B:
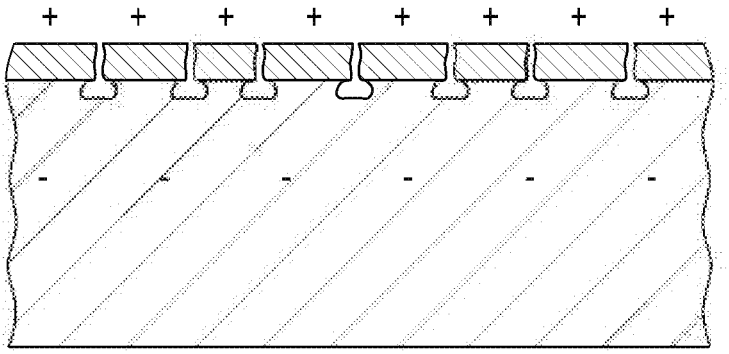
FIG. 8B shows a top view of a micro crack network of a deformed surface of a structured coating according to the present disclosure.

FIG. 8A shows a top view of a micro crack network of a deformed surface of a structured coating according to the present disclosure. FIG. 8B shows a top view of a micro crack network of a deformed surface of a structured coating according to the present disclosure. The micro cracks result from deforming (bending) of the metallic article after plating with four layers as shown in FIG. 2 obtained by controlling the current density as shown in FIG. 3A. It can be seen that a dense network of micro cracks enables a fine dispersion of corrosion current resulting in low, uniform corrosion.

Figure 9A:
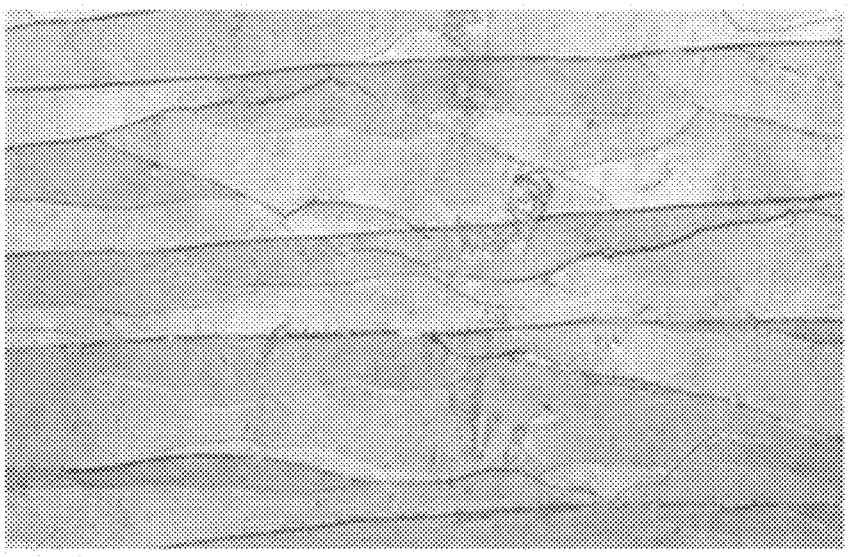
FIG. 9A shows a top view of a micro crack network of a deformed surface of a conventional homogeneous coating.
Figure 9B:
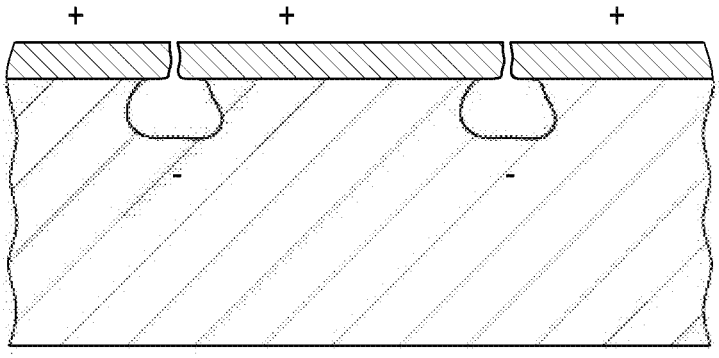
FIG. 9B shows a cross sectional view of a micro crack network of a deformed surface of a conventional homogeneous coating.

FIG. 9A shows a top view of a micro crack network of a deformed surface of a conventional homogeneous coating. FIG. 9B shows a cross sectional view of a micro crack network of a deformed surface of a conventional homogeneous coating. Again, the micro cracks result from deforming (bending) of a conventional metallic article which was plated with a homogenous coating (i.e., no separate layers). In contrast to the micro cracks of the metallic article shown in FIGS. 8A and 8B, a smaller number and less dispersed micro cracks will focus the corrosion current and result in strong, localized corrosion.

In summary, the present disclosure presents an electrochemical process for forming a structured layer of zinc alloy layers. During the plating process, low to medium current densities are alternated with high current densities. The change intervals take place in the minute range and lead to a structured zinc alloy layer comprising individual layers in the micrometer range. The individual layers differ, among other things, in their chemical composition. By proper selection of the process parameters, the structured layer exhibits a corrosion performance that is equal to or better than that of an unstructured layer.

The disclosed process provides an enhanced corrosion performance, even after deformation (including crimping, bending, pressing, etc.) of the metallic article. The corrosion resistance of the (micro-) lamellar layer after deformation is significantly better than that of the monolithic layers commonly used today.

Further, the modulated direct current deposition of zinc alloy layers can be done in an economically advantageous and less complex process, optionally including post-treatment with passivation and sealing. Other advantageous effects of the laminar microstructure on layer properties such as assembly behavior, alloy element ion release or tribology. Even a process acceleration may be achieved.

Thus, the foregoing discussion discloses and describes merely exemplary embodiments of the present disclosure. As will be understood by those skilled in the art, the present disclosure may be embodied in other specific forms without departing from the spirit or essential characteristics thereof. Accordingly, the disclosure of the present disclosure is intended to be illustrative, but not limiting of the scope of the disclosure, as well as other claims. The disclosure, including any readily discernible variants of the teachings herein, defines, in part, the scope of the foregoing claim terminology such that no inventive subject matter is dedicated to the public.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

What is claimed is:

1. Method of forming a multilayered zinc alloy coating, the method comprising:

providing a bath of an aqueous electrolyte including zinc and a second electrodepositable component in an electrolytic cell having an anode and a cathode;

applying a current or voltage between the anode and the cathode;

modulating the applied current or voltage over time between at least two current or voltage values to thereby modulate the current density over multiple cycles between at least two current density values, wherein a second current density value is higher than a first current density value; and controlling the modulation of the applied current or voltage to obtain a multilayered structure having multiple layers of one or more of alternating proportions of the second component, alternating corrosion potential, alternating grain size, and alternating grain orientation, wherein one or more of the multiple layers has a thickness in the range of 1 to 10 μm;

wherein the second electrodepositable component is one of nickel, cobalt, copper, gold, silver, platinum, chromium, lead, tin or a combination thereof;

wherein the modulation of the applied current or voltage is controlled to form the multilayered structure having 2 to 12 layers;

wherein the multilayered structure is configured to form a dense network of micro-cracks upon deformation; and wherein the multilayered zinc alloy coating is formed by use of i) a rack, wherein the first current density value is in a range of 0.5 to less than 2 $A/dm^2$ and the second current density value is in a range of 2 to less than 5 $A/dm^2$, or ii) a barrel, wherein the first current density value is in a range of 0.3 to 1 $A/dm^2$ and the second current density value is in a range of 0.6 to 2 $A/dm^2$.

2. Method as claimed in claim 1, wherein the modulation of the applied current or voltage is controlled to form the multilayered structure having 4 to 12 layers.

3. Method as claimed in claim 1, wherein the modulation of the applied current or voltage is controlled to form the multilayered structure having multiple layers, each having a thickness in the range of 1 to 10 μm.

4. Method as claimed in claim 1, wherein the modulation of the applied current or voltage is controlled to form the multilayered structure having a total thickness in the range of 5 to 25 μm, and/or wherein the modulation of the applied current or voltage is controlled to alternate the current density over multiple cycles between at least two different current density values, wherein each of the current density values is applied in a cycle for a duration in the range of 30 seconds to 60 minutes.

5. Method as claimed in claim 1, wherein one or more chemical or physical parameters of alloying metal content, crystal structure and micro cracks, are controlled for forming the final layer of the multilayered structure.

6. Method as claimed in claim 1, wherein, when the multilayered zinc alloy coating is formed by use of a rack, the second current density value is higher than the first current density value by a value difference in the range of 0.5 to 4 $A/dm^2$.

7. Method as claimed in claim 1, wherein, when the multilayered zinc alloy coating is formed by use of a barrel, the second current density value is higher than the first current density value by a value difference in the range of 0.2 to 1 $A/dm^2$.

8. Method as claimed in claim 1, further comprising a step of forming a passivation layer on top of the multilayered structure by mutual corrosion protection reinforcement of plating and passivation layer properties, and optionally forming a sealing layer on top of the passivation layer.

9. Method as claimed in claim 8, wherein one or more parameters for forming the final layer of the multilayered structure and for forming the passivation layer are controlled so that in the forming of the passivation layer the top part of the final layer of the multilayered structure is converted to form at least part of the passivation layer.

10. Method as claimed in claim 8, wherein the passivation layer is formed from one or more of chromium oxide, zirconium oxide, zinc oxide, titanium oxides, vanadium oxides, organofunctional silanes, and organic polymers.

11. Method as claimed in claim 8, wherein the current or voltage applied for forming the final layer of the multilayered structure is controlled to form the final layer having a higher proportion of the second component than the penultimate layer.

* * * * *